US006280121B1

(12) United States Patent
Khamis

(10) Patent No.: US 6,280,121 B1
(45) Date of Patent: Aug. 28, 2001

(54) REINFORCED RETAINING WALL

(76) Inventor: Suheil R. Khamis, egoz 36 Code 17500 P.B. 1757, Nazareth Ilit (IL)

( * ) Notice: Subject to any disclaimer, the term of this patent is extended or adjusted under 35 U.S.C. 154(b) by 0 days.

(21) Appl. No.: 09/559,556

(22) Filed: Apr. 27, 2000

Related U.S. Application Data

(62) Division of application No. 08/994,327, filed on Dec. 19, 1997, now Pat. No. 6,089,792.

(51) Int. Cl.[7] ..... E02D 29/02

(52) U.S. Cl. ..... 405/284; 405/287; 52/439; 52/604; 52/606

(58) Field of Search ..... 405/258, 262, 405/284–287, 272, 273; 52/439, 606, 604

(56) References Cited

U.S. PATENT DOCUMENTS

| | | | | |
|---|---|---|---|---|
| 3,421,326 | | 1/1969 | Vidal | 405/284 |
| 3,686,873 | | 8/1972 | Vidal | 405/262 |
| 3,717,967 | * | 2/1973 | Wood | 52/259 |
| 4,045,965 | | 9/1977 | Vidal | 405/287 |
| 4,073,148 | | 2/1978 | Zaretti | 405/287 |
| 4,116,010 | | 9/1978 | Vidal | 405/262 |
| 4,117,686 | | 10/1978 | Hilfiker | 405/284 |
| 4,324,508 | | 4/1982 | Hilfiker et al. | 405/284 |
| 4,329,089 | | 5/1982 | Hilfiker et al. | 405/262 |
| 4,391,557 | | 7/1983 | Hilfiker et al. | 405/287 |
| 4,505,621 | | 3/1985 | Hilfiker et al. | 405/284 |
| 4,643,618 | | 2/1987 | Hilfiker et al. | 405/287 |
| 4,957,395 | | 9/1990 | Nelson | 405/287 |
| 4,961,673 | | 10/1990 | Pagano et al. | 405/287 |
| 5,064,313 | * | 11/1991 | Risi et al. | 405/284 |
| 5,308,195 | | 5/1994 | Hotek | 405/284 |
| 5,395,185 | | 3/1995 | Schnabel | 405/287 |
| 5,522,682 | | 6/1996 | Egan | 405/262 |
| 5,558,470 | | 9/1996 | Elmore et al. | 405/262 |
| 5,568,998 | | 10/1996 | Egan et al. | 405/262 |
| 5,580,191 | | 12/1996 | Egan | 405/262 |
| 5,582,492 | | 12/1996 | Doyle | 405/262 |
| 5,586,841 | | 12/1996 | Anderson et al. | 405/286 |
| 5,673,530 | | 10/1997 | Bailey | 52/606 |

* cited by examiner

*Primary Examiner*—Christopher J. Novosad
(74) *Attorney, Agent, or Firm*—E. Alan Uebler, P.A.

(57) ABSTRACT

A reinforced retaining wall is provided comprised of precast, concrete block facing elements connected by suitable connectors to reinforcing members which extend from the facing elements into the adjacent reinforced soil to form a mechanically stabilized earthen wall construction. The connectors which affix the reinforcing members at their connecting ends to the facing elements comprise concrete poured into a part or all of certain of the void spaces within selective facing blocks, which concrete may or may not be reinforced and which concrete, when dry and cured, envelops and secures the connecting ends of the reinforcement members to their corresponding blocks and forms anchors thereat. In addition, wall constructions are provided having reinforcement members with differing reinforcement characteristics placed at different elevations of a wall, as desired, to accommodate specific design requirements, such as, for example, soil nails, metallic grids and geotextiles, all of which are employed as reinforcements in a single wall construction.

5 Claims, 6 Drawing Sheets

REINFORCED RETAINING WALL

CROSS-REFERENCE TO RELATED APPLICATION

This application is a division of prior application Ser. No. 08/994,327, filed Dec. 19, 1997, now U.S. Pat. No. 6,089,792.

BACKGROUND OF THE INVENTION

The invention relates to mechanically stabilized earthen wall constructions, in particular, to reinforced retaining walls comprising precast facing elements connected by suitable connectors to reinforcing elements which extend into reinforced soil.

Of the four basic classes of retaining walls, i.e., gravity, cantilever, anchored and mechanically stabilized backfill, the present invention relates primarily to the first and the latter two, although elements of all are included in the improved wall system according to the invention.

By way of background, gravity walls depend upon the weight of the wall itself to prevent overturning and sliding of the wall. A cantilever wall is reinforced in order to resist applied moments and shear forces. Anchored walls resist lateral forces through the use of tieback anchors or soil nails. And mechanically stabilized backfill includes reinforcement members extending backwardly from the front face of the wall into the retained embankment soil to form a coherent mass. Enhanced reinforcement is attained, at least in part, by increased frictional shear resistance and passive resistance which occurs between the soil in the embankment and the reinforcing members. Conventional reinforcing members can be in the form of strips, grids, sheets, rods or fibers which increase the resistance of the soil to tensile forces far beyond those which the soil alone is able to withstand.

Both metallic (steel) and nonmetallic, polymeric (geotextile, geogrid) materials have been used for reinforcement purposes. By definition herein, metallic reinforcements such as steel will be termed "inextensible" or "rigid" materials and nonmetallics such as geogrids and geotextiles will be termed "extensible" or "flexible" materials, owing to their disparate elastic moduli and creep resistance properties, and to be more or less consistent with similar usage in prior literature in this art.

A mechanically stabilized backfill wall system generally comprises four essential components: (1) facing elements; (2) the connection or connectors connecting the facing elements and the reinforcing elements; (3) the reinforcing elements themselves; and (4) the reinforced soil, all of which comprise the reinforced retaining wall system. The facing elements may be precast, modular concrete blocks. The front face of such blocks may be covered with a decorative material, such as slate or the like, which is generally employed solely for aesthetic purposes.

Use of strip or rod reinforcements creates a mechanically stabilized backfill by placing such reinforcements in horizontal planes between successive lifts of soil backfill. Grid reinforcement systems are formed by placing metal or polymeric grid elements in horizontal planes vertically spaced apart in the soil backfill. An example of such a polymeric grid reinforcement is Tensar Geogrid, commercially available from the Tensar Corporation.

Reinforced retaining walls have many uses, particularly in the road building industry wherein these constructions are used to retain embankments and as roadway supports. Further uses of such walls include sea walls, bridge abutments and other, similar configurations.

Several prior retaining wall systems are known. For example, U.S. Pat. No. 4,961,673 discloses a retaining wall construction comprised of a first portion which includes compacted granular fill defining a three dimensional earthenwork bulk form which includes a plurality of tensile members dispersed within the bulk form to enhance the coherency of the mass. The tensile members project from the bulk form and are connected to a second component portion which defines a face construction. The face construction is comprised of a plurality of facing panels connected to tensile members with concrete layers enveloping the connection between the facing panels and the tensile members. See also the references cited in the '673 patent, which disclose many and varied embodiments of reinforced retaining wall systems. A recently issued U.S. Pat. No. U.S. 5,586,841, discloses a modular block wall which includes dry cast, unreinforced modular wall blocks with anchor type, frictional type or composite type soil stabilizing elements recessed therein and attached thereto by vertical rods which also connect the blocks together. The soil stabilizing elements are positioned in counterbores or slots in the blocks and project into the compacted soil behind the courses of modular wall blocks. The many and varied connector means disclosed in that patent, all of which are unrelated to the connectors of the present invention, provide indications of the current state of this art in the retaining wall field.

Mechanically stabilized backfill systems have many advantages over other types of systems including relatively easy and rapid construction, stability of the wall during construction, regardless of height or length, relative flexibility with respect to lateral deformation and differential vertical settlements, and, importantly, economic advantages. Disadvantages may include corrosion of metallic reinforcements (which may be minimized by galvanizing or resin coatings), excessive creep in the case of polymeric reinforcements and the depth and expanse of excavation needed in certain instances.

Objects and advantages of the present retaining wall system are many and varied. The present wall can be constructed as a gravity wall or with reinforced, retaining soil. The retained soil can be reinforced with a specific, designed, combination of reinforcements, all employed in a single wall construction, such as a combination of soil nails or soil anchors, geosynthetic sheets and metallic grids, all designed and specified to produce a safe and economical structure.

According to the invention, the facia may be used as a constructive component, which can transfer loads into the foundation soil without affecting the wall performance, that is, the facia can serve as a foundation to superstructures.

Modular units of the invention may be constructed from a lower foundation level up to a certain designated height employing reinforced backfill, above which height the wall can be constructed as a conventional gravity wall, thus allowing increased construction flexibility, for example permitting unrestricted excavation of the retained soil near the crest of the wall to install utilities, etc.

The connections according to the invention between the reinforcement members and the facing blocks are massive and exceedingly strong, allowing the use of very high strength reinforcements and enabling stable wall construction extending vertically to extreme heights, e.g., 20 meters or more, higher than heretofore achievable. Both rigid walls, allowing for small horizontal displacement of the retained soil, and flexible walls, allowing for appreciable horizontal wall displacements, are possible, providing flexibility in design and allowing for versatility in design options, all while enabling the design of economically attractive high and low walls, optionally having curved facades and corners, and all possessing aesthetically pleasing appearances.

The objects, advantages and specific features of the invention are set forth in detail in the detailed description hereinbelow.

SUMMARY OF THE INVENTION

A gravity retaining wall construction for an earthenwork bulk form is provided. The wall includes a plurality of precast concrete block facing elements stacked one on top of another and in side by side relationship in generally horizontal rows extending vertically upwardly from a first row resting upon a foundation plane adjacent the bulk form, each block facing element having void spaces or openings extending vertically therethrough. The blocks are stacked such that openings in the blocks in one row coincide with openings in the blocks in rows vertically adjacent the one row, and so on, upwardly from a first row to a top row. The blocks have poured concrete means at least partially filling coincident void spaces of a selected number, including all, of vertically adjacent blocks at selected horizontal spacing distances along the length of the wall. Each poured concrete means extends vertically upwardly and downwardly within the voids to a distance above and below the plane of intersection between vertically adjacent blocks, whereby the poured concrete means provides effective interlocking of vertically stacked blocks, providing a gravity wall suitable for retention of the earthenwork bulk form.

The distance above and the distance below the plane of intersection between blocks preferably are both approximately 15 cm and the portion of coincident void spaces not filled by poured concrete is filled with compacted granular soil. The reinforced retaining wall may have poured concrete means completely filling the coincident void spaces extending vertically upwardly from the foundation plane through all rows of the block to thereby form a vertical soldier beam reinforcement for the wall.

In an alternative embodiment according to the invention, a reinforced retaining wall construction is provided including a plurality of precast concrete block facing elements stacked one on top of another and in side by side relationship in generally horizontal rows extending vertically upwardly from a first row resting upon a foundation plane adjacent a bulk earth form to be retained. Each block facing element has void spaces or openings extending vertically therethrough. The blocks are stacked such that openings in the blocks in one row coincide with openings in the blocks in rows vertically adjacent the one row, and so on, upwardly from a first row to a top row. The wall has reinforcement means generally in the form of rods, bars, sheets, grids and/or soil nails and anchors oriented in generally horizontal planes (nails and anchors may extend downwardly to the horizontal 15° or more) and extending generally horizontally from the front face of the block facing elements, between selected rows of the block facing elements and backwardly into the earthenwork bulk form to a considerable distance therein, and are embedded therein. The blocks have poured concrete means filling at least a portion, including all, of the openings in the facing blocks adjacent each reinforcement means to provide concrete connector means rigidly enveloping and securing the reinforcement means to the stacked facing blocks, to provide a mechanically stabilized, reinforced earthen wall construction. The poured concrete means preferably extends vertically upwardly and downwardly within the voids to a distance above and below the plane of intersection between vertically adjacent blocks and fills the openings to a distance of approximately 15 cm above and below the plane of intersection. The portion of the openings in the facing blocks which is not filled with poured concrete is filled with compacted granular soil.

The reinforcement means may include metallic grid, geotextile and geogrid sheets, soil anchors or nails, or a specified combination of reinforcement means, including combinations of metallic grids and geotextile or geogrid sheets and soil nails and anchors.

The retaining wall may have a decorative covering material such as slate covering its front face, for aesthetic reasons.

In a further embodiment, a reinforced retaining wall construction is provided including a plurality of precast concrete block facing elements stacked one on top of another and in side by side relationship in generally horizontal rows extending vertically upwardly from a first row resting upon a foundation plane adjacent the bulk form. Each block facing element has void spaces or openings extending vertically therethrough, and the blocks are stacked such that the openings in the blocks in one row coincide with the openings in the blocks in rows vertically adjacent the one row, and so on, upwardly from the first row to a top row. This further embodiment includes a combination of both relatively inextensible and extensible reinforcement means, generally in the form of rods, sheets, grids and/or soil nails and anchors or tiebacks oriented in generally horizontal planes, extending from selected rows of stacked block facing elements at selected elevations, and being connected thereat and thereto by suitable connectors. The reinforcement means extend backwardly and into the earthenwork bulk form to a considerable distance therein, and are embedded within the bulk form. The more extensible reinforcement means in such constructions are all positioned vertically above the inextensible reinforcement means in increasing order of extensibility, thereby providing a mechanically stabilized, reinforced, relatively flexible earthen wall construction. This combination of reinforcement means may include metallic grids, geotextile and geogrid sheets and soil nails, all employed in a single construction.

The method for constructing the walls of the invention is also provided.

BRIEF DESCRIPTION OF THE DRAWINGS

Reference is directed to the accompanying drawings, wherein.

DETAILED DESCRIPTION OF THE INVENTION AND PREFERRED EMBODIMENTS WITH REFERENCE TO THE DRAWINGS

A reinforced retaining wall is provided comprised of precast, concrete block facing elements connected by suitable connectors to reinforcing members which extend from the facing elements into the adjacent reinforced soil to form a mechanically stabilized earthen wall construction. The connectors which affix the reinforcing members at their connecting ends to the facing elements comprise concrete poured into a part or all of certain of the void spaces within selective facing blocks, which concrete may or may not be reinforced and which concrete, when dry and cured, envelops and secures the connecting end of the reinforcement members to their corresponding blocks and forms anchors thereat. In addition, wall constructions are provided having reinforcement members with differing reinforcement characteristics placed at different elevations of a wall, as desired, to accommodate specific design requirements, such as, for example, soil nails, prestressed tiebacks, metallic grids and polymeric materials, all of which are employed as reinforcements in a single wall construction.

Figure 1:
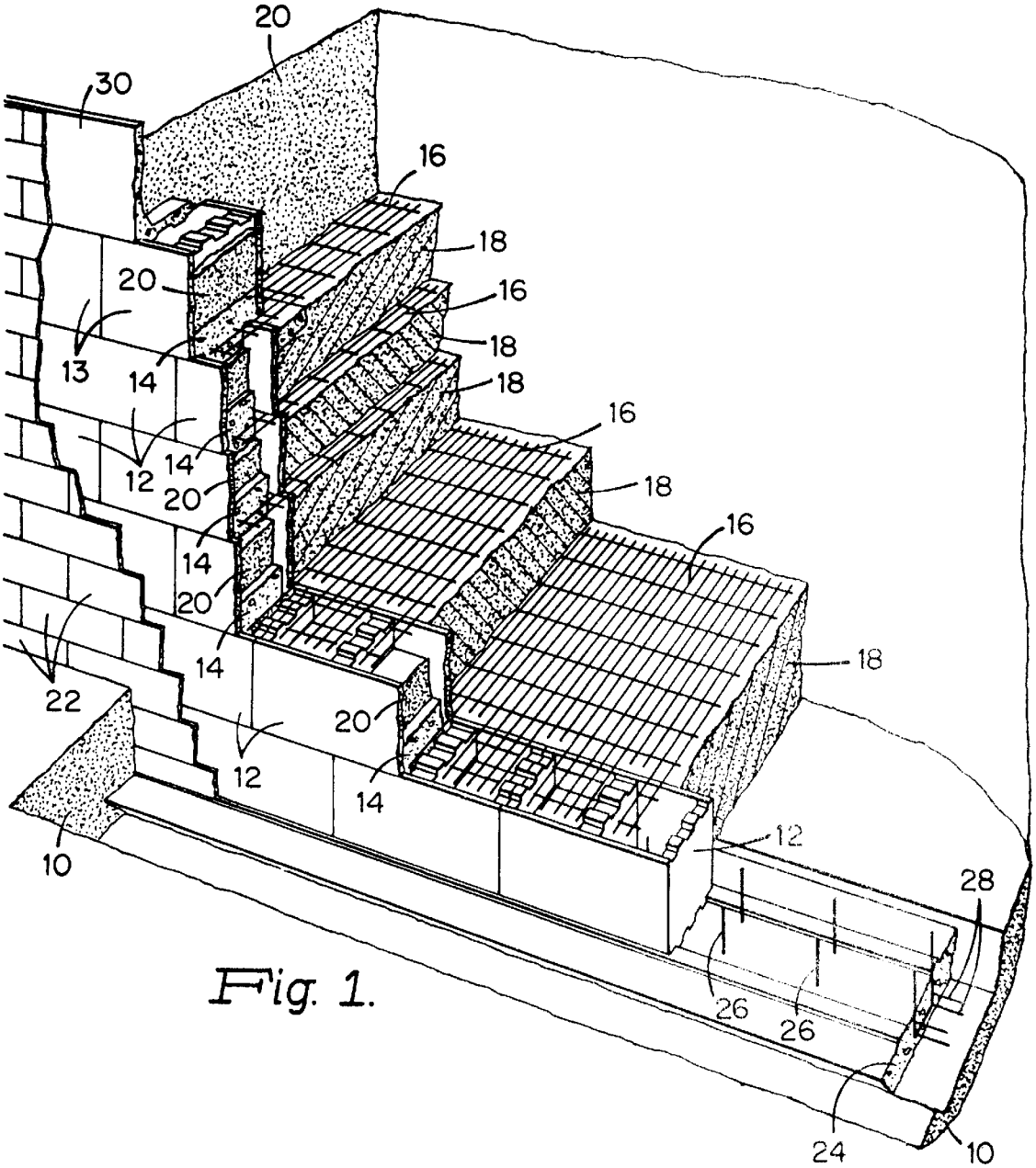
FIG. 1 is an isometric perspective view, having portions thereof partially cut away, of one embodiment of a reinforced retaining wall according to the invention, forming a mechanically stabilized earthen wall construction.

A detailed description of the stabilized earthen wall construction of the invention and the preferred embodiments thereof is best provided with reference to the accompanying drawings wherein FIG. 1 is an overall isometric perspective view of one embodiment, with portions cut away for illustrative purposes. Therein is shown a natural (or manmade) soil embankment 10, partially excavated, and concrete foundation or footer 24 having been laid using conventional techniques. Dry, precast modular concrete block facing elements 12 are stacked in rows, as shown, having staggered, overlapping orientation to one another row-to-row, and engaging each other in a conventional tongue-in-groove fashion, as shown and described in more detail below. Generally horizontally oriented grids 16 act as reinforcement members and are placed between successive lifts of soil and between rows of blocks 12 and extend from the front face of the blocks 12 backwardly into the soil 18 to provide reinforcement members to mechanically stabilize the soil by providing additional shear and passive resistance forces reacting against the outwardly directed pressure forces generated in the soil being retained. The reinforcement members 16 should be cut away in regions between rows of blocks at and near the tongue and groove connectors to ensure that connections between stacked blocks are clear and fit together perfectly.

The stable wall system is achieved by connector means providing a firm connection between the reinforcement grids 16 and the facing blocks 12. This connection allows the reinforcement members to transfer tensile loads due to lateral earth pressures into the stable soil, that is, soil not supported by the facia. Connection and anchorage of the reinforcement members 16 into the block facing elements 12 is achieved by pouring concrete or mortar 14 into the voids of the blocks 12 as shown. The voids inside the blocks 12 are filled preferably with alternating layers of compacting granular soil 20 and concrete 14. The concrete fill 14 is cast-in-place to produce a firm, massive and strong connection between the reinforcement 16 and the facing block elements 12. The reinforcing elements 16 are depicted as steel grids, but other types of grids may be employed such as geogrids and geotextiles. In certain applications, ground anchors may be used, and this is discussed in more detail below. Where ground anchors are used, concrete can be poured into the vertically adjacent and connecting voids formed by several stacked blocks, with or without placement of steel reinforcement in the voids, to provide, in effect, a vertical soldier beam connecting the soil anchors to the blocks.

As construction of the wall proceeds from the foundation 24 upwardly, fill soil 18 is replaced as necessary.

For completeness, the top row of facing blocks 30 is composed preferably of cantilevered, gravity supported L-shaped blocks 30, filled by backfill 20 as shown, and, for aesthetic purposes, covering material such as slate panels 22 may be adhered, usually with mortar, to the front face of the wall. Steel reinforcements 26 and 28 may be employed when and where needed.

Figure 2:
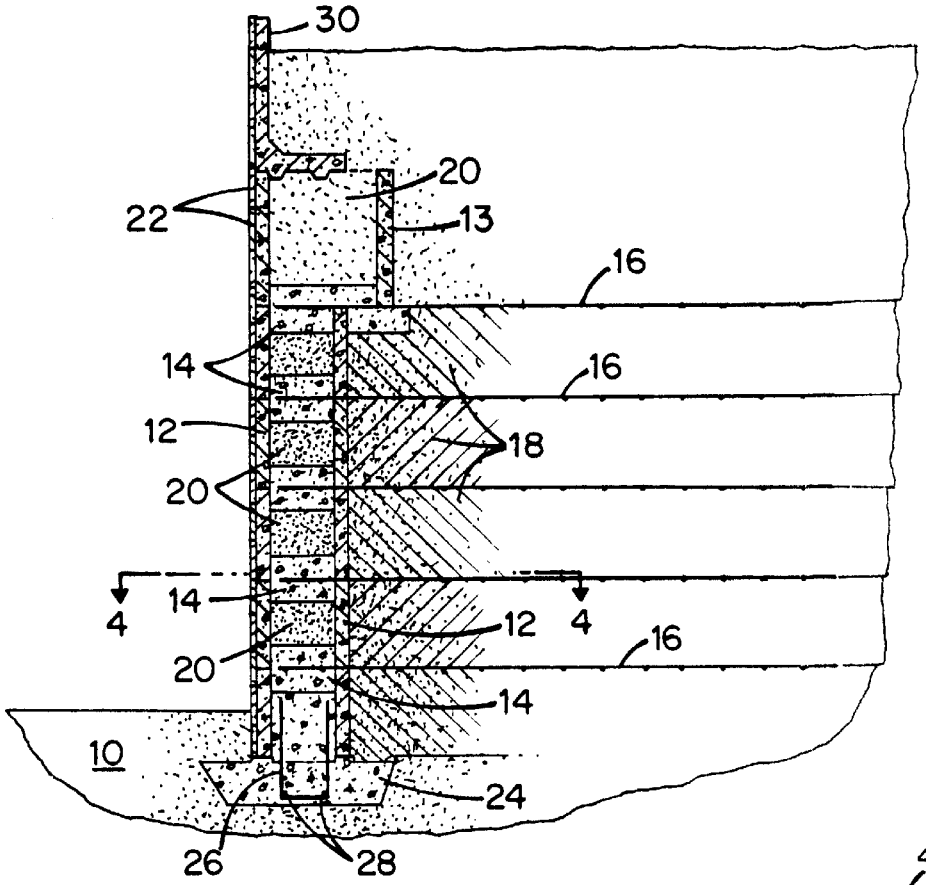
FIG. 2 is a cross-sectional side elevation of the wall construction depicted in FIG. 1.

FIG. 2 is a cross-sectional side elevation of the wall construction depicted in FIG. 1. The construction, proceeding upwardly from the unexcavated natural soil 10, includes concrete foundation 24 on which are stacked rows of precast concrete blocks 12. Between the blocks 12, and extending from the front face of the blocks 12 (left side in the drawing) generally horizontally backwardly (to the right in the drawing) through the adjacent blocks and into the soil 18 behind the blockwork, the reinforcement members 16 are shown extending back a sufficient distance into stable soil behind the blockwork. The reinforcement members 16 which are sandwiched at their connection ends between adjacent vertical rows of blocks 12 are secured and anchored thereat by pouring concrete 14 in situ into the voids of blocks 12, as shown, and allowing the concrete to set therein to form massive anchors rigidly connecting the reinforcement members 16 to the blocks 12. As stated, the voids in blocks 12 preferably are filled with alternating layers of concrete 14 and compacted granular fill soil 20, as shown in FIG. 2, but concrete could also fill the adjacent vertical void spaces at specified lateral wall locations to form rigid, vertical soldier beam reinforcement members for the retaining wall extending from its foundation to its very top section.

The top row of reinforced blocks 13 is shown as larger than the underlying block elements 12 and supports the top row of facing blocks 30, all filled with backfill 20 and, as shown, being gravity supported. Covering panels 22 are affixed to the front faces of blocks 12, 13 and 30. Steel rods 26 and 28 to reinforce the concrete may be included if specified.

Figure 3:
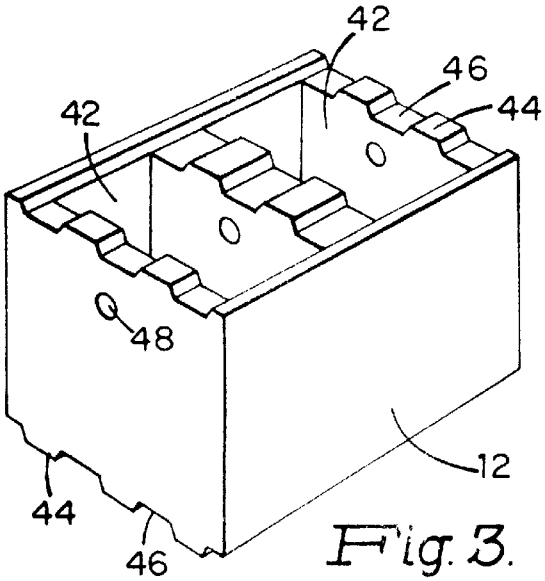
FIG. 3 is a perspective view of a preferred precast, concrete block facing element suitable for use in the retaining wall according to the invention.

FIG. 3 shows a perspective view of a typical block 12 useful in constructing the wall of the invention. Therein is shown the block 12 having vertical through-openings or voids 42 therein, and having conventional tongue 44 and groove 46 construction to enable such blocks to fit mechanically and snugly together, row upon row, to thereby prevent any shifting of blocks with respect to each other. Openings 48 permit passages for utility lines and the like to pass through. Openings 48 also permit grasping and lifting of the blocks by a crane or other means at the construction site to facilitate block placement and wall construction at the site. While block dimensions are not critical, preferred sizes are described below in connection with describing the method of construction of the retaining wall of the invention.

Figure 4:
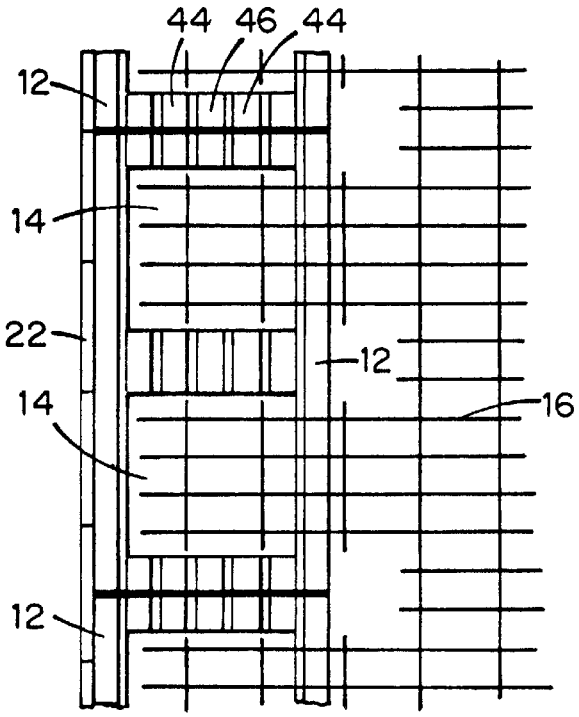
FIG. 4 is an enlarged cross-sectional top plan view taken along line 4—4 of FIG. 2.

FIG. 4 is an enlarged, partial cross-sectional top plan view taken along line 4—4 of FIG. 2. Therein, the grid 16 extends over the blocks 12. At portions of the grid 16 where tongue and groove sections 44, 46 of overlapping blocks fit together, the grid 16 is cut away so as not to interfere with the snug fit of blocks 12. Concrete anchor sections 14 rigidly secure the grids 16 into the facing wall.

Figure 5:
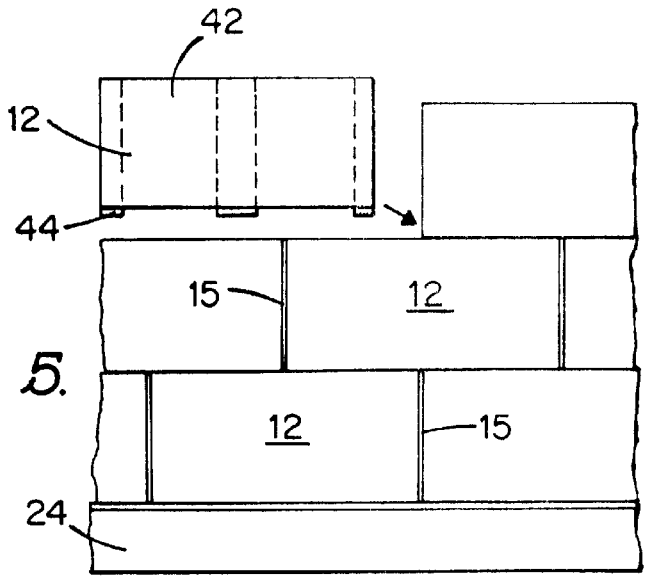
FIG. 5 is a front elevation depicting assembly of the concrete block facing elements of the invention, preferably in staggered, overlapping orientation as shown, i.e., one course of block oriented in staggered fashion with respect to an adjacent row of block.

FIG. 5 depicts in front elevation the assembly of block facing elements 12 in staggering or overlapping array, as shown, all stacked in rows upon foundation 24. It is preferable and important for drainage purposes that a space or gap 15 between adjacent blocks be maintained. A constant horizontal spacing of 10 mm between blocks is preferably maintained, and this may be achieved using spacers bonded to the sides of the blocks. To ensure long term drainage through the gaps 15 without washout therethrough of soil particles, mesh strips of nonwoven geotextile material may be affixed over these gaps before replacement of the backfill soil.

Figure 6:
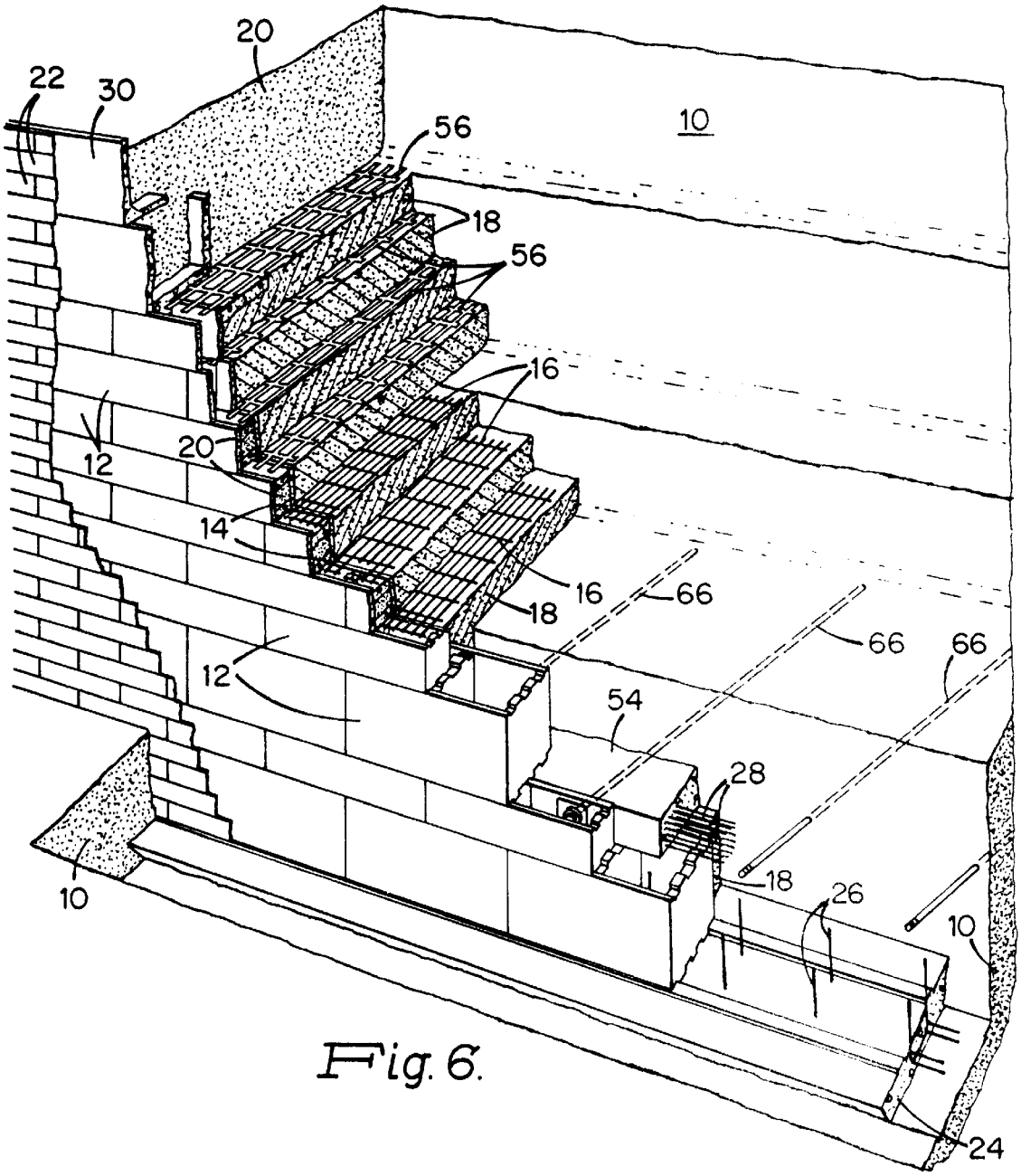
FIG. 6 is a perspective view, having portions thereof partially cut away, of another embodiment of the retaining wall of the invention wherein reinforcement means such as prestressed ground anchors, tiebacks, soil nails, inextensible metallic grids and extensible geotextile sheets are all incorporated, in combination, to form the mechanically stabilized construct, described in detail below.

FIG. 6 is a perspective view, portions of which are cut away, showing a reinforced retaining wall wherein different reinforcement members are employed within a single stabilized wall construction. Therein, precast concrete blocks 12 are stacked upon one another in rows as before, resting upon cast-in-place foundation 24. For rocky embankments or otherwise difficult to excavate soil, or for other technical reasons, it may be desirable to use soil nails 66 or prestressed anchors as reinforcing members in the lower regions of the wall construction. These soil nails 66 may be anchored to blocks 12 by pouring concrete anchors 14 into the voids 42 of the block 12 to which the soil nail is connected. Alternatively, optionally and additionally, a reinforced, relatively massive horizontal concrete beam 54 may be poured in place and used to anchor the soil nails 66 and/or prestressed anchors or tiebacks.

Proceeding upwardly through successive lifts of backfill and rows of blocks 12, it may be desirable and required under engineering specifications to employ inextensible, metallic reinforcement grids 16 at intermediate levels of the retaining wall and extensible polymeric reinforcement members 56 such as geotextiles and geogrids at the upper levels of the wall. These reinforcement members are all placed as before, and concrete anchoring means 14 are poured into the respective voids 42 of blocks 12 to anchor the reinforcement members to the blocks 12 at their connecting ends. Construction of the wall depicted in FIG. 6 is otherwise similar to that described previously, and may include installation of decorative coverings 22 adhered to the front faces of blocks 12.

Figure 7:
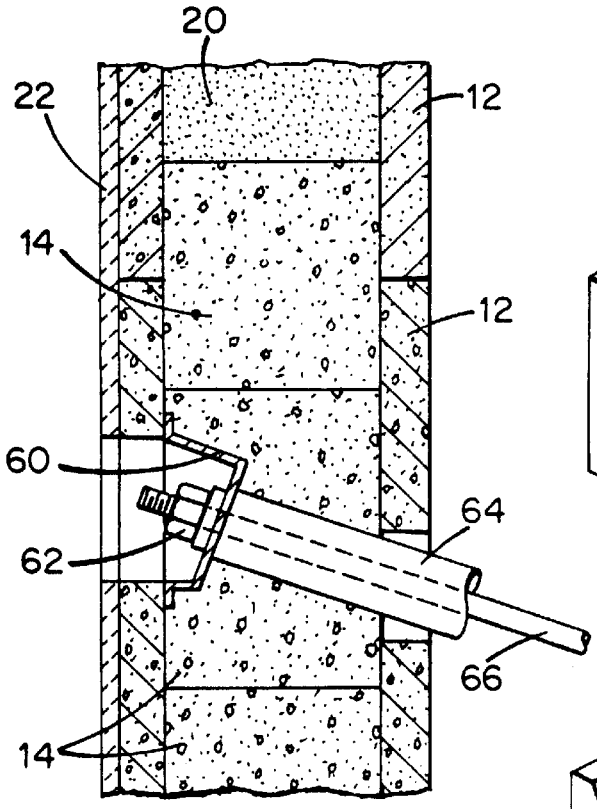
FIG. 7 is a partial cross-section of a connection between a prestressed ground anchor or soil nail and a concrete facing block, depicting the intersection of block and anchor or nail, all embedded in and connected and anchored by poured, cured concrete.

FIG. 7 is a partial side elevation, in cross-section, of a connection between a ground anchor 66 and its connecting block 12. Therein the anchor 66 having sleeve 64 is affixed by connecting nut 62 to anchor bracket 60, and the entire connection is made rigid and anchored thereat by the poured-in-place concrete layer 14. This anchor may be prestressed by turning the nut against the reaction provided by the vertical or horizontal beam.

Figure 8:
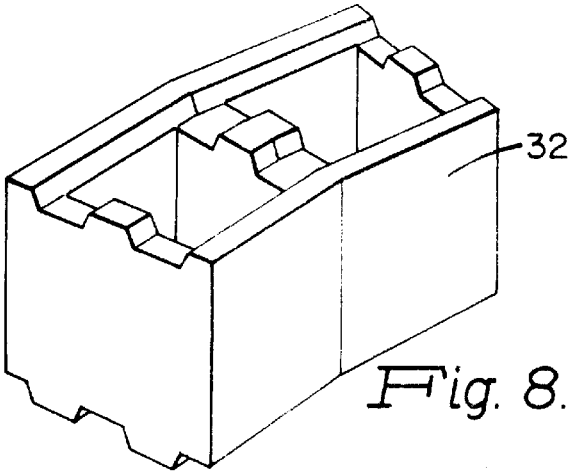
FIG. 8 is a perspective view of a concrete block useful in the present invention in the formation of curved wall surfaces.
Figure 9:
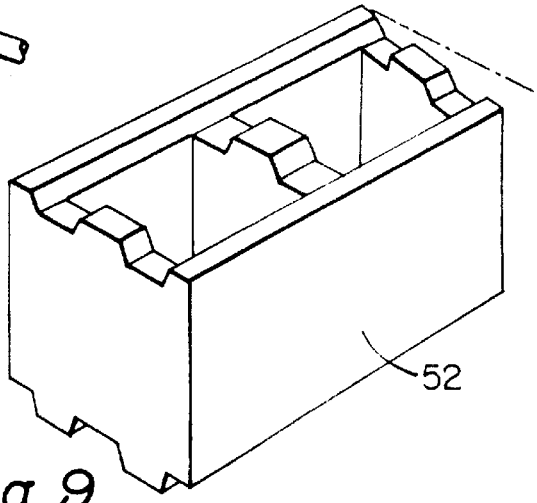
FIG. 9 is a prospective view of a concrete end block suitable for use with the block of FIG. 8 in forming curved wall surfaces.

FIGS. 8 and 9 depict precast concrete block configurations 32 and 52 useful in the construction of curved wall front faces.

Figure 10:
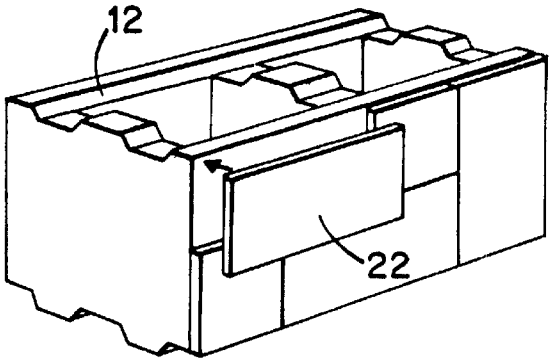
FIG. 10 is a perspective view of a block facing element used with the present invention and having its front face covered by a finishing cover material such as slate.

FIG. 10 depicts the assembly of covering material 22, such as slate panels, affixed to the front face of block 12.

Figure 11:
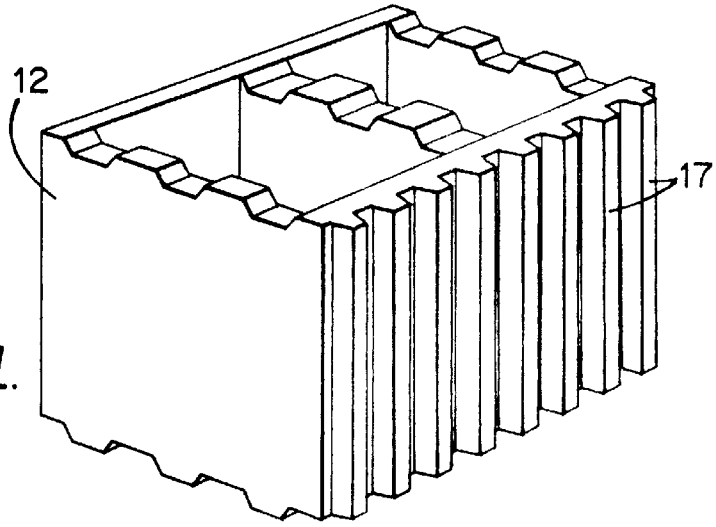
FIG. 11 is a perspective view of a block facing element of the invention show its rear, ribbed wall surface, which ribbed surface contacts back fill in the wall construction.
Figure 12:
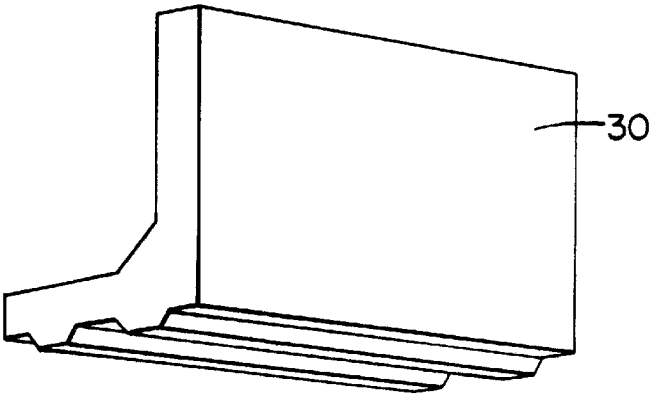
FIG. 12 is a perspective view of a top row, finishing block, to be installed on the top row of block facing elements and supported thereat as a gravity wall, to complete the structural and aesthetic features of the wall of the invention.

FIG. 11 shows a rear view of a block 12 having a ribbed rear wall configuration 17 for enhanced contact with backfill soil, and FIG. 12 is a perspective view of an L-shaped block 30 preferably used in the top run of blocks as described above.

Figure 13:
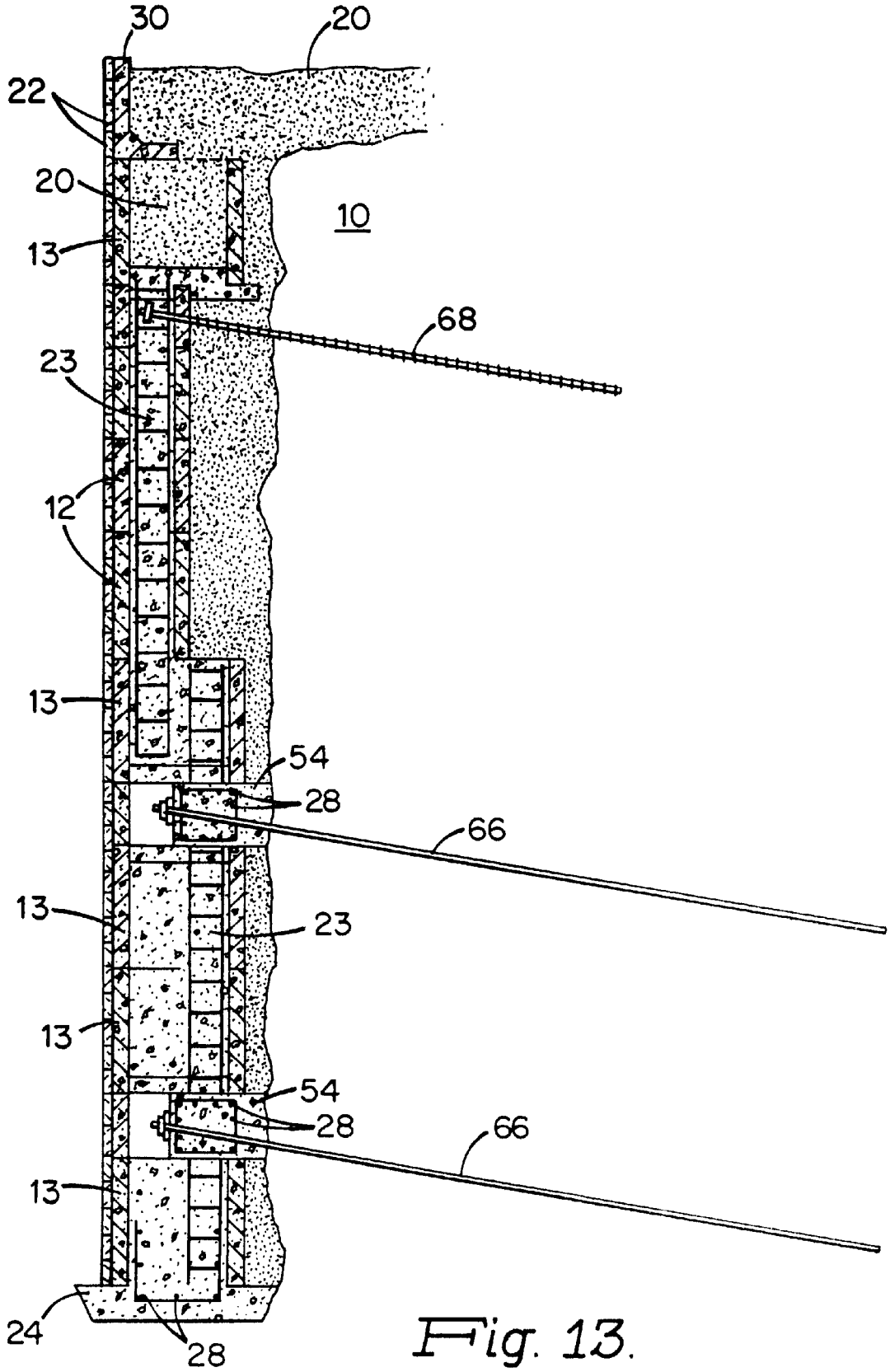
FIG. 13 is a cross-sectional view of a still further embodiment of the invention depicting poured concrete filling aligned cavities in vertically oriented blocks, row to row, forming vertical soldier beam reinforcements for the wall, and horizontally oriented, optionally steel-reinforced concrete anchor beams which anchor and connect soil nails and prestressed ground anchors to the facing block elements, as shown.

FIG. 13 is a side elevational, cross-sectional view of a further embodiment of the invention wherein facing blocks 12 are stacked vertically in rows, as before, upon foundation 24. In the embodiment shown, minimal excavation behind the facing has been performed. Rather, prestressed anchors 66 are employed to rigidly connect the block facing wall to the embankment 18, not shown in the figure. The lower connectors of the soil nails are encased in and anchored by horizontal, poured-in-place, reactive concrete beams 54, which may or may not be reinforced, such as, for example, by steel reinforcing rods 28.

The upper soil nail 68, at its connecting end, may be anchored thereat to block 12 by concrete poured into block 12 as before or, as shown in FIG. 13, is anchored in a poured concrete vertical column 23 extending through several runs of block and performing essentially as a reinforced soldier beam thereat. Similar, vertically oriented soldier beams 23 may be placed at selected lateral spacings apart in the construction of the wall, according to engineering specifications. Such a vertical beam 23 is shown in FIG. 13 connecting, rigidly, the two lower soil anchors depicted therein.

Method of Construction

Generally, concepts according to the invention may be employed in the construction of otherwise conventional gravity walls, or with reinforced, retained soil. Importantly, the retained soil can be reinforced with a combination of reinforcements such as soil nails or soil anchors, geosynthetic (or other extensible) sheets and metallic (or other inextensible) grids, all in a single construction, providing both a safe and an economical structure.

Precast concrete blocks used as the wall facing elements serve three purposes. They provide lateral support for the reinforced soil, anchor the reinforcement at the front end, and render an aesthetically pleasing wall appearance. The proper combination of blocks makes it possible to construct gravity walls to significant heights without additional soil reinforcement. The maximum height of such a wall will depend on several factors such as the dimensions of the blocks, number of parallel blocks producing a row, properties of the backfill soil and the foundation soil, external forces, and the design earthquake intensity. Economics indicates that, typically, the maximum height of an unreinforced wall will be limited to about 3.5 m. Taller walls may be constructed with reinforced soil. Reinforcement materials to be employed include galvanized steel grids, geotextiles, geogrids, and/or ground anchors (i.e., prestressed tiebacks and/or soil nails). The economics resulting from the natural soil terrain may dictate a combination of ground anchors together with planar reinforcement materials. As described above, the stable wall system of the invention is obtained by providing a firm connection between the reinforcement members employed and the facing blocks. This connection allows for the reinforcement to transfer tensile loads due to lateral earth pressures backwardly into the stable soil. (Herein, "stable soil" means soil that is not supported by the facia.)

The basic precast block unit is shown schematically in FIG. 3. Preferably, its external dimensions are 1200/600/580 mm, having walls 80 and 100 mm thick. The front face of the block can be covered by decorative material such as slate, see FIG. 10. Bonding the cover to the block is done using mortar, and the cover is for aesthetic purposes only.

Referring to FIG. 1, the elevation of the leveling pad 24 should be at least 30 cm below the final grade in front of the wall, or as otherwise specified by the design engineer. The leveling pad is made of cast-in-place concrete which can be poured directly against the sides of the excavated trench. FIG. 1 illustrates a typical leveling pad, including steel reinforcement 26 to tie together the pad 24 and the first row of blocks 12.

To construct a gravity wall, the following steps are preferably undertaken:

1. Excavate a ditch for the leveling pad 24 to a minimal depth of 60 cm. The width of the ditch should be no less than the width of the first row of blocks. The top of the leveling pad should be at least 30 cm below the final grade of the soil in front of the wall, or as otherwise specified by the design engineer.

2. Pour concrete into the excavated ditch to form the leveling pad, preferably concrete with a minimum compressive strength of 200 kg/cm$^2$. Steel to reinforce the concrete should be used as specified.

3. Place the first row of block over approximately a 3 cm layer of mortar (i.e., the mortar is inserted between the top of the leveling pad and the bottom of the blocks). To ensure drainage, a spacing of 10 mm is provided between adjacent blocks (see FIG. 5)

4. Pour concrete into each block's voids, preferably up to 15 cm below the top of the block (see FIGS. 1 and 2). Concrete with a minimum compressive strength of 300 kg/cm$^2$ (about 30 MPa) is preferred.

5. Place layers of backfill soil and compact to specified density. Fill to the top of the first row of blocks.

6. Place another layer of blocks on top of the first row. Blocks are 'connected' to each other by 'groove and tongue'. A space of 10 mm in between blocks is maintained for drainage.

7. The volume of voids in each block is filled either with granular soil or concrete. If concrete is used as fill, steel reinforcement may be included. Concrete fill will produce, in effect, a standard gravity wall with 'rigid' facing. Soil fill will produce, in effect, a standard gravity wall with a relatively flexible facing.

8. Repeat steps 5, 6, and 7 for additional rows of blocks and layers of backfill, until the desired height is obtained.

To construct a reinforced retaining wall, the following steps are preferably undertaken:

Steps 1 through 5 are the same as above for the gravity wall, followed by:

6. Steel grid, made of rolled steel, ribbed and galvanized, meeting appropriate standards, is to be employed. Polymeric reinforcements or ground anchors will be selected according to specifications. The required strength of the reinforcement will be determined by the designer. To ensure adequate connection, the front end of the metallic or polymeric reinforcement must be placed within the block void as illustrated in FIGS. 1–4. FIG. 13 shows the connection of prestressed anchors and soil nails to the facing. FIG. 7 depicts details of the connection of a prestressed anchor to the facing. The reinforced concrete poured into the voids in the blocks, intended to connect the anchors (or nails), should be provided according to the design using concrete, preferably with a minimal compressive strength of 200 kg/cm$^2$ (about 200 MPa).

7. When using metallic reinforcements, the longitudinal and transverse steel bars should be cut as shown in FIG. 4. This is necessary to ensure that the 'groove and tongue' connection between two stacked blocks remain clear thus ensuring a perfect fit. When using polymeric material, the reinforcement should also be cut so as not to interfere with the fitting in between stacked blocks.

8. Place another row of blocks, leaving 10 mm space between blocks for drainage.

9. Place reinforced backfill soil in layers and compact to meet specifications; fill to the top of the row of blocks.

10. Pour concrete into the voids of each block, preferably up to 15 cm above the bottom of the new row of blocks as shown in FIG. 2. For ground anchors, concrete to 'lock' two stacked blocks will be poured in the voids that are not being used for the vertical soldier beam. That is, concrete is poured, similar to the case of planar reinforcement, to produce increased shear resistance between stacked blocks. If no reinforcement is used, the design may still require concrete between stacked blocks to increase interblock shear resistance.

11. The remaining volume of the voids in the blocks may be filled with compacted granular soil, preferably up to 15 cm below the top of each block.

12. Steps 6 through 11 are repeated until the desired wall height is attained.

In general, the length of the reinforcement material (steel grid or polymeric material), perpendicular to the wall face, should be uniform and at least 0.7 the height of the wall (height is measured from leveling pad to the top of the uppermost row of blocks). British standards and American guidelines allow for shorter reinforcement lengths at the bottom ('Trapezoidal Wall'). The minimum length of the ground anchors should be at least that of the other reinforcing materials. It should be noted that while the invention enables the use of mixed reinforcements (i.e., a mixture of steel grid and/or polymeric and/or ground anchors to provide a combination of 'extensible' and 'inextensible' reinforcement for the same wall), there is presently no known design method specifically addressing such a hybrid reinforcement system. However, such combination of reinforcements can be used provided modified design calculations show that design requirements (for each type of reinforcement used) are met and that the ground anchors at the construction site can produce the strength assumed in design. Generally, the concrete connections between the reinforcement and the blocks in the above-described wall is massive and, typically, exceeds the tensile strength of the reinforcement itself. Additionally, the reinforced soil and its placement are critical factors in the long term performance of the wall. U.S. standards for such constructions must be followed.

While the invention has been disclosed herein in connection with certain embodiments and detailed descriptions, it will be clear to one skilled in the art that modification or variations of such details can be made without deviating from the gist of this invention, and such modifications or variations are considered to be within the scope of the claims hereinbelow.

What is claimed is:

1. A gravity retaining wall construction for an earthenwork bulk form comprising a plurality of precast concrete block facing elements stacked one on top of another and in side by side relationship in generally horizontal rows extending vertically upwardly from a first row resting upon a foundation plane adjacent said bulk form, each of said block facing elements having void spaces or openings extending vertically therethrough, said blocks being stacked such that openings in said blocks in one row coincide with openings in the blocks in rows vertically adjacent said one row, and so on, upwardly from said first row to a top row, said blocks having poured concrete means partially filling the coincident void spaces of a selected number, including all, of vertically adjacent blocks at selected horizontal intervals along the length of said wall, each said poured concrete means extending vertically upwardly and downwardly within said voids to a distance above and below the plane of intersection between said vertically adjacent blocks, and wherein the portion of coincident void spaces not filled by poured concrete is filled with compacted granular soil, whereby each said poured concrete means provides reinforcement for said wall, said wall being a gravity wall suitable for retention of said earthenwork bulk form.

2. The retaining wall of claim 1 wherein said distance above and said distance below the plane of intersection between blocks are both approximately 15 cm.

3. The retaining wall of claim 1 having poured concrete means completely filling said coincident void spaces extending vertically upwardly from said foundation plane through all rows of said block facing elements at selected horizontal locations to form vertical soldier beam reinforcements for said wall.

4. The retaining wall of claim 1 wherein the front faces of said facing elements are covered by a decorative covering material.

5. The retaining wall of claim 4 wherein said covering material is slate.

* * * * *